US009736576B2

(12) United States Patent
Shinotsuka et al.

(10) Patent No.: US 9,736,576 B2
(45) **Date of Patent: *Aug. 15, 2017**

(54) ENERGY CONVERSION APPARATUS AND SPEAKER STRUCTURE

(71) Applicant: RICOH COMPANY, LTD., Tokyo (JP)

(72) Inventors: Michiaki Shinotsuka, Kanagawa (JP); Tsutomu Kawase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 5 days.

This patent is subject to a terminal disclaimer.

(21) Appl. No.: 14/819,605

(22) Filed: Aug. 6, 2015

(65) Prior Publication Data

US 2016/0044419 A1 Feb. 11, 2016

(30) Foreign Application Priority Data

Aug. 11, 2014 (JP) ..... 2014-163638
Apr. 14, 2015 (JP) ..... 2015-082216

(51) Int. Cl.

| | |
|---|---|
| ***H04R 9/06*** | (2006.01) |
| ***H04R 1/34*** | (2006.01) |
| ***H04R 9/04*** | (2006.01) |
| *H04R 7/12* | (2006.01) |
| *H04R 19/01* | (2006.01) |

(Continued)

(52) U.S. Cl.

CPC ..... *H04R 1/34* (2013.01); *H04R 7/12* (2013.01); *H04R 9/047* (2013.01); *H04R 1/028* (2013.01); *H04R 7/122* (2013.01); *H04R 19/005* (2013.01); *H04R 19/013* (2013.01); *H04R 2307/025* (2013.01)

(58) Field of Classification Search

CPC . H04R 9/06; H04R 7/12; H04R 9/047; H04R 1/34; H04R 9/045; H04R 7/122; H04R 1/028; H04R 2307/025; H04R 15/00; H04R 3/00; H04R 1/00; H04R 9/00; H04R 2201/003; H04R 9/04; H04R 1/02; H04R 19/005; H04R 19/013; H02K 41/025

USPC ..... 381/408

See application file for complete search history.

(56) References Cited

U.S. PATENT DOCUMENTS 1,757,451 A * 5/1930 Crane ..... H04R 7/06 181/166
3,164,686 A * 1/1965 Tibbetts ..... H04R 9/047 181/170

(Continued)

FOREIGN PATENT DOCUMENTS

JP 02214399 A * 8/1990 ..... H04R 1/44
JP 2004-072647 3/2004

(Continued)

OTHER PUBLICATIONS

The Partial European search report dated Dec. 10, 2015.
Extended European Search Report dated Mar. 15, 2016.

*Primary Examiner* — Davetta W Goins
*Assistant Examiner* — Oyesola C Ojo
(74) *Attorney, Agent, or Firm* — IPUSA, PLLC

(57) ABSTRACT

An energy conversion apparatus including a permanent magnet fixed to a predetermined region; and a diaphragm arranged on the permanent magnet, the diaphragm including a coil having a conductor wire pattern formed on the diaphragm, wherein the diaphragm includes a slit formed in the diaphragm.

9 Claims, 22 Drawing Sheets

(51) Int. Cl.
*H04R 19/00* (2006.01)
*H04R 1/02* (2006.01)

(56) References Cited

U.S. PATENT DOCUMENTS 3,922,502 A * 11/1975 Tabuchi ..... H04R 9/047 381/408
4,030,564 A * 6/1977 Itagaki ..... G10K 11/002 181/158
4,581,496 A * 4/1986 Sweany ..... H04R 11/00 181/166
4,939,784 A * 7/1990 Bruney ..... H04R 7/10 181/170
5,003,609 A * 3/1991 Muraoka ..... H04R 9/047 381/117
5,249,237 A 9/1993 Paddock
5,304,746 A * 4/1994 Purvine ..... H04R 7/14 181/148
5,361,304 A * 11/1994 Jones ..... H04R 9/047 381/401
7,142,687 B2 * 11/2006 Hanada ..... H04R 9/047 381/412
7,165,453 B2 * 1/2007 Flora ..... B06B 1/04 367/168
7,627,134 B2 * 12/2009 Garner ..... B60R 11/0217 381/399
8,077,903 B2 * 12/2011 McKenzie ..... H04R 7/122 381/423
2003/0052671 A1 * 3/2003 Kawase ..... G01R 33/02 324/249
2005/0078850 A1 4/2005 Norton
2005/0230006 A1 * 10/2005 Ohashi ..... C04B 35/46 148/281
2006/0098839 A1 5/2006 Ishigaki et al.
2009/0028376 A1 * 1/2009 Saito ..... H04R 7/12 381/423
2009/0179514 A1 * 7/2009 Takeuchi ..... H02K 29/03 310/156.48
2015/0003661 A1 1/2015 Shinotsuka
2015/0071483 A1 3/2015 Shinotsuka et al.

FOREIGN PATENT DOCUMENTS

JP 2004-357147 12/2004
JP 2005-151405 6/2005
JP 2007-318554 12/2007
JP 2010-251816 11/2010
JP 5262599 8/2013
JP 2015-029245 2/2015

* cited by examiner

FIG.13

| | DIAPHRAGM SLIT SHAPE | SOUND PRESSURE (dB) 10kHz | 17kHz | 19kHz |
|---|---|---|---|---|
| EXAMPLE 1 | FPC: 34mm*100mm<br>COIL ZONE: 26mm*80mm<br>COIL TERMINAL: 2 TERMINALS<br>COIL ZONE<br>WITHOUT SLIT | 50 | 50 | 46 |
| EXAMPLE 2 | SLIT: 2mm*80mm*2 PIECES<br>COIL ZONE<br>FPC | 54 | 52 | 47 |
| EXAMPLE 3 | SLIT: 2mm*10mm*4 PIECES<br>COIL ZONE<br>FPC | 49 | 50 | 47 |
| EXAMPLE 4 | SLIT: 2mm*20mm*4 PIECES<br>COIL ZONE<br>FPC | 52 | 50 | 47 |
| EXAMPLE 5 | SLIT: 2mm*40mm*2 PIECES<br>COIL ZONE<br>FPC | 52 | 47 | 47 |
| EXAMPLE 6 | SLIT: 2mm*20mm*4 PIECES<br>COIL ZONE<br>FPC | 52 | 47 | 47 |
| EXAMPLE 7 | SLIT PORTION IS DELETED<br>COIL ZONE<br>FPC | 49 | 48 | 42 |

FIG.14

| | DIAPHRAGM SLIT SHAPE | SOUND PRESSURE (dB) 10kHz | 17kHz | 19kHz |
|---|---|---|---|---|
| EXAMPLE 8 | FPC: 40mm*100mm<br>COIL ZONE: 32mm*80mm<br>COIL TERMINAL: 2 TERMINALS<br>COIL ZONE<br>WITHOUT SLIT | 53 | 52 | 52 |
| EXAMPLE 9 | SLIT: 1mm*5mm*1 PIECE<br>COIL ZONE<br>FPC | 55 | 53.5 | 53 |
| EXAMPLE 10 | SLIT: 1mm*5mm*2 PIECES<br>COIL ZONE<br>FPC | 55 | 54 | 53 |
| EXAMPLE 11 | SLIT: 1mm*10mm*2 PIECES<br>COIL ZONE<br>FPC | 55 | 53 | 52 |
| EXAMPLE 12 | SLIT: 1mm*15mm*2 PIECES<br>COIL ZONE<br>FPC | 55 | 53 | 53 |
| EXAMPLE 13 | SLIT: 1mm*20mm*2 PIECES<br>COIL ZONE<br>FPC | 55 | 51 | 51 |
| EXAMPLE 14 | SLIT: 1mm*25mm*2 PIECES<br>COIL ZONE<br>FPC | 55 | 51 | 50 |
| EXAMPLE 15 | SLIT: 1mm*30mm*2 PIECES<br>COIL ZONE<br>FPC | 55 | 51.5 | 51 |
| EXAMPLE 16 | SLIT: 1mm*40mm*2 PIECES<br>COIL ZONE<br>FPC | 55 | 52 | 52 |
| EXAMPLE 17 | SLIT: 1mm*40mm*2 PIECES<br>COIL ZONE<br>FPC | 55 | 52 | 52 |

FIG.15

| | DIAPHRAGM SLIT SHAPE | SOUND PRESSURE (dB) 10kHz | 17kHz | 19kHz |
|---|---|---|---|---|
| EXAMPLE 18 | FPC: 36mm*118mm, COIL ZONE, FPC, WITHOUT SLIT | 59 | 54 | 54 |
| EXAMPLE 19 | SLIT: 1mm*8mm*8 PIECES, COIL ZONE, FPC | 62 | 56.5 | 56 |
| EXAMPLE 20 | SLIT: 2mm*8mm*8 PIECES, COIL ZONE, FPC | 64 | 58 | 57 |

FIG.18A

SOUND PRESSURE [dB]; FREQUENCY 17kHz

| | MEASUREMENT POSITION (ANGLE) | | | |
|---|---|---|---|---|
| | 0 | 30 | 60 | 90 |
| EXAMPLE 20 | 64 | 64 | 64 | 58 |
| COMPARATIVE EXAMPLE | 63 | 53 | 41 | 35 |

FIG.18B

SOUND PRESSURE [dB]; FREQUENCY 17kHz

| | MEASUREMENT POSITION (ANGLE) | | | |
|---|---|---|---|---|
| | 0 | 30 | 45 | 60 |
| EXAMPLE 20 | 64 | 63 | 58 | 53 |
| COMPARATIVE EXAMPLE | 63 | 53 | 41 | 35 |

ENERGY CONVERSION APPARATUS AND SPEAKER STRUCTURE

BACKGROUND OF THE INVENTION

1. Field of the Invention

The present invention relates to an energy conversion apparatus of mutually converting an electric energy and a mechanical energy.

2. Description of the Related Art

An exemplary energy conversion apparatus of mutually converting an electric energy and a mechanical energy is a speaker or a microphone. In the speaker, a coil arranged in proximity to a permanent magnet is vibrated by an electromagnetic force and a diaphragm fixed to the coil causes air to vibrate so as to generate sound waves. On the other hand, in the microphone, the diaphragm is vibrated by the sound waves so that an electric current flows through a coil integrated (interlocking) with the diaphragm by a function of electromagnetic induction.

Conventionally, a cone diaphragm is frequently used for a speaker. In recent years, a thin speaker (a so-called flat speaker) using a plate diaphragm has been attracting public attention (see, for example, Patent Document 1).

Although the above flat speaker is highly valuable depending on a usage, there is a restriction in an installation location and an energy conversion efficiency is not always sufficient.

Patent Document 1: Japanese Patent No. 5262599

SUMMARY OF THE INVENTION

Accordingly, embodiments of the present invention provide a novel and useful energy conversion apparatus solving one or more of the problems discussed above.

One aspect of the embodiments of the present invention may be to provide an energy conversion apparatus including a permanent magnet fixed to a predetermined region; and a diaphragm arranged on the permanent magnet, the diaphragm including a coil having a conductor wire pattern formed on the diaphragm, wherein the diaphragm includes a slit formed in the diaphragm.

Additional objects and advantages of the embodiments will be set forth in part in the description which follows, and in part will be clear from the description, or may be learned by practice of the invention. Objects and advantages of the invention will be realized and attained by means of the elements and combinations particularly pointed out in the appended claims.

BRIEF DESCRIPTION OF THE DRAWINGS

FIG. 13 illustrates examples of the speaker structure.

FIG. 14 illustrates examples of the speaker structure.

FIG. 15 illustrates examples of the speaker structure.

FIGS. 18A and 18B illustrate exemplary measurement results of the directivity characteristics.

DETAILED DESCRIPTION OF THE PREFERRED EMBODIMENTS

A description is given below, with reference to the FIG. 1 through FIG. 23 of embodiments of the present invention. Where the same reference symbols are attached to the same parts, repeated description of the parts is omitted.

Reference symbols typically designate as follows:

10: diaphragm;
12: flexible substrate;
14: coil;
14*a*: plus terminal;
14*b*: minus terminal;
15: fixing member;
16: slit;
17: securing hole;
20: permanent magnet;
30: buffer film;
40: highly magnetic permeable sheet;
50: structure body;
51: first groove;
52: second groove; and
53: securing part.

Hereinafter, embodiments of the present invention are described in detail. Within the embodiment, described is a speaker structure as an energy conversion apparatus. However, the present invention is not limited to this embodiment and is applicable to other energy conversion apparatuses such as a microphone or an electric fan. Hereinafter, in the following figures, the same reference symbols are attached to the same elements, and an overlapping explanation is properly omitted. The shapes and the relative scales of members may be modified, if necessary.

<Example of Basic Configuration>

Figure 1:
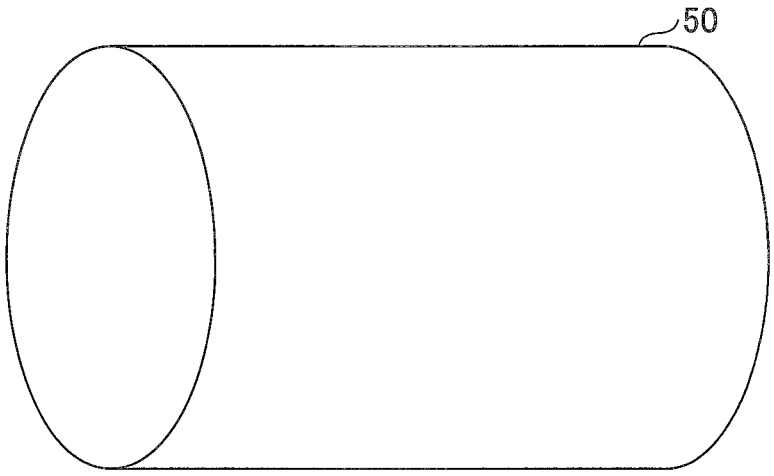
FIG. 1 illustrates an exemplary structure body to which a speaker structure is attached.

FIG. 1 illustrates an example of a structure body 50, to which a speaker structure 100 is attached. In the example, the structure body 50 is shaped like a cylinder. In this case, a curved surface (a peripheral surface) of the structure body 50 in a cylindrical shape is a region to which the speaker structure is attached. One specific example where the structure body 50 in a cylindrical shape is the region, to which the speaker structure is attached, is a socket component or the like of a straight tube fluorescent lamp. The shape of the structure body 50, to which the speaker structure is attached, is not limited to the cylindrical shape and may be a curved surface obtained by bending a rectangular object. Further, the shape of the structure body 50 may be spherical. The embodiment is applicable to the structure body including the curved surface.

Described next is processes of attaching the speaker structure to the structure body 50.

Figure 2:
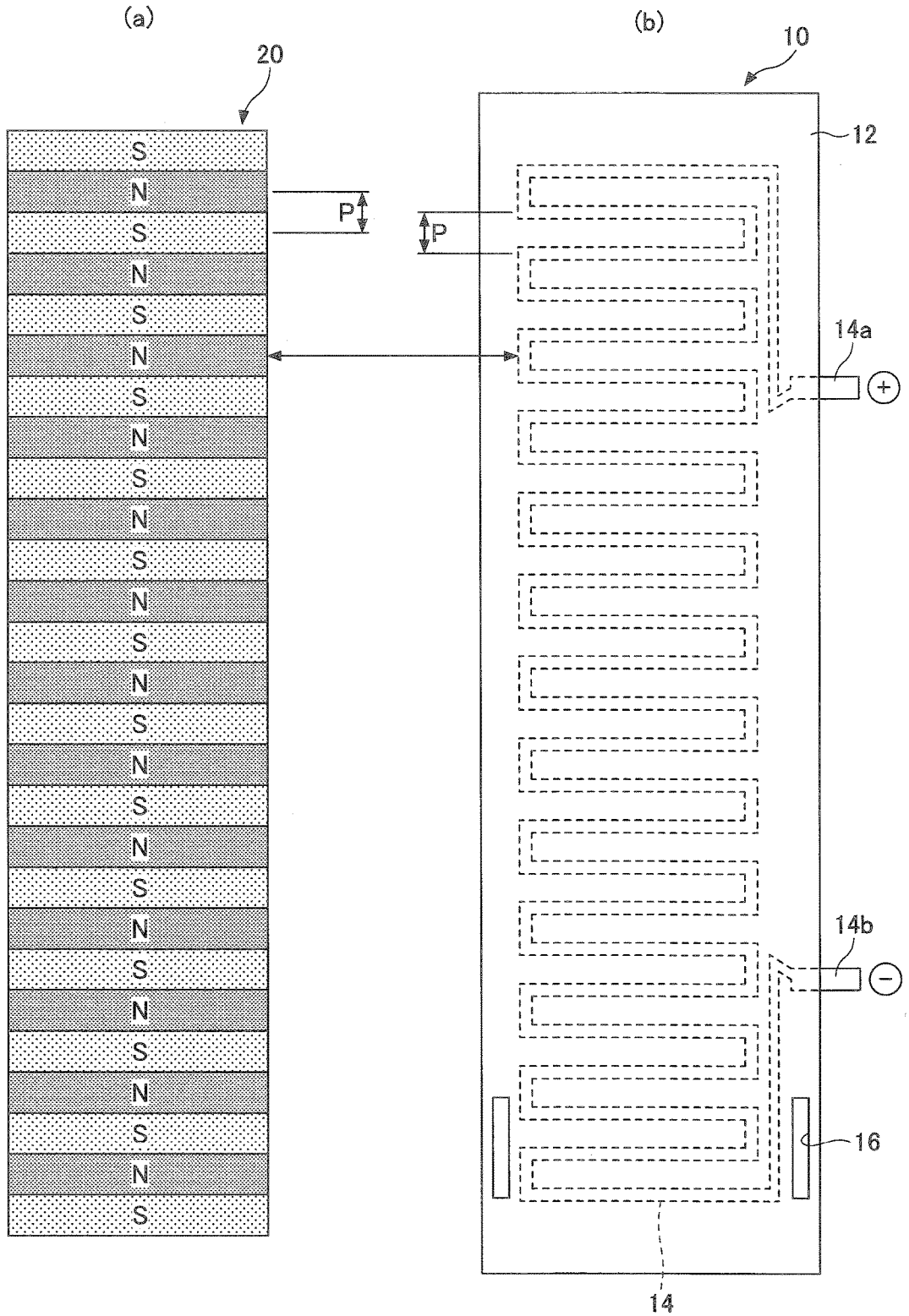
FIG. 2 illustrates an exemplary diaphragm and an exemplary permanent magnet.

Referring to FIG. 2, a diaphragm 10 in (a) and a permanent magnet 20 in (b) are prepared.

The diaphragm 10 may be formed by a flexible substrate 12 having flexibility and having a thickness of about 10 μm to about 30 μm. The flexible substrate 12 preferably has a bending elastic modulus of about 2000 MPa to about 3000 MPa, and may be made of, for example, polyethylene terephthalate (PET), polyimide, polyethylene naphthalate (PEN), or the like.

The shape of the flexible substrate 12 is a vertically long rectangle. It is preferable to set the width of the vertically long rectangle to be similar to the length of the structure body 50 (see FIG. 1). It is preferable to set the length of the vertically long rectangle to be similar to the outer periphery of the structure body 50 (see FIG. 1).

A coil 14 is provided on one surface (a back surface in FIG. 2) of the flexible substrate 12. The coil 14 has a conductor wire pattern shaped like a meander or a pulse. Parts of the conductor wire extending in the width direction of the flexible substrate 12 are arranged interposing a predetermined pitch P. The conductor wire pattern can be formed by, for example, wet etching of the flexible substrate 12 having a copper foil or printing of copper paste on the flexible substrate 12 by means of screen printing. Further, the coil 15 includes a plus terminal 14*a* and a minus terminal 14*b*.

Further, a predetermined number of rectangular slits 16 having a predetermined size are formed in the flexible substrate 12. The slit 16 is provided to improve the level of a sound pressure output as a speaker and loosen the directionality. A specific example of the size and the number of the slits 16 is described later. The slit 16 may be formed by punching or drilling.

The shape of the permanent magnet 20 is shaped like a vertically long rectangle. The width and the length of the permanent magnet 20 is set to have an appropriate length depending on the width and the length of the conductor wire pattern of the coil 14 of the diaphragm 10. Further, it is preferable to form the permanent magnet 20 by a sheet-like bond magnet (a rubber magnet) so that the shape of the permanent magnet 20 is freely deformable in conformity with the curved surface of the structure body 50 (FIG. 1). The permanent magnet 20 may be made of ferrite magnet, neodymium magnet, alnico magnet, samarium-cobalt magnet, or the like. Preferably, the permanent magnet 20 is made of neodymium magnet.

A parallelly streaky magnet pattern is provided to the permanent magnet 20 so that widthwise extending north poles in a band-like shape and widthwise extending south poles in a band-like shape are alternately arranged. The pitch P between the widthwise extending north pole and the widthwise extending south pole in the parallelly streaky magnet pattern is determined so as to be equal to the pitch P of the coil 14 formed on the diaphragm 10.

Figure 3A:
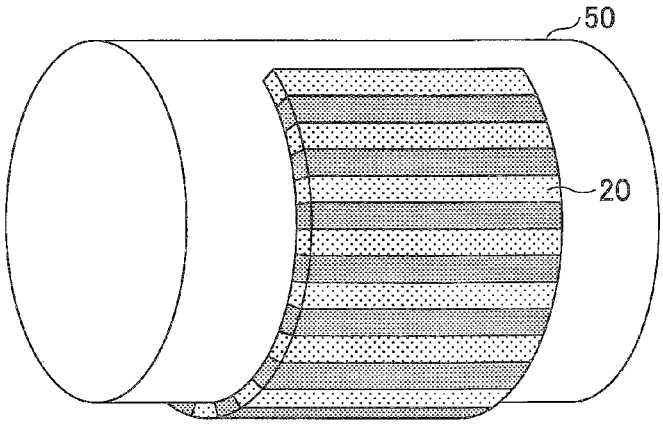
FIGS. 3A to 3C illustrate an exemplary procedure of producing the speaker structure.

After the above described diaphragm 10 and the above described permanent magnet 20 are prepared, the permanent magnet 20 is wound around an outer peripheral surface of the structure body 50 as illustrated in FIG. 3A and is fixed thereto. A recess having the depth corresponding to the thickness of the permanent magnet 20 may be formed on the outer peripheral surface of the structure body 50. Then, the permanent magnet 20 can be embedded in the recess of the structure body 50.

Figure 3B:
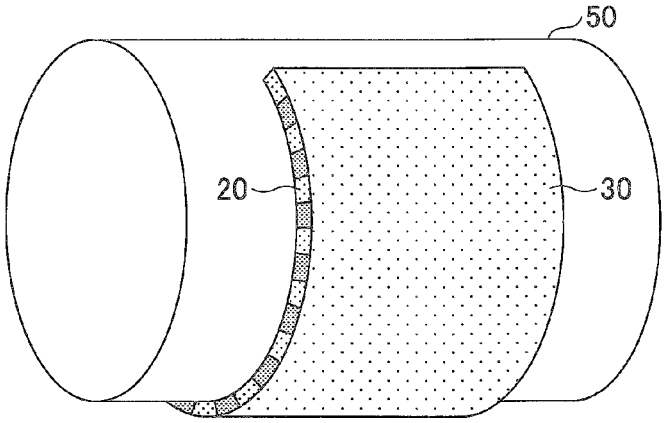

Thereafter, as illustrated in FIG. 3B, the buffer film 30 is arranged so as to cover the entire surface of the permanent magnet 20. By providing the buffer film 30, adherence between the diaphragm 10 and the permanent magnet 20, avoidance of divided vibration of the diaphragm 10, and a range of movement necessary for the diaphragm 10 to vibrate while maintaining a sufficient amplitude are ensured.

The buffer film 30 is made of a non-magnetic material having a flexibility, and intervenes between the permanent magnet 20 and the diaphragm 10 so as to constantly maintain a distance between the permanent magnet 20 and the diaphragm 10. The buffer film 30 preferably has a thickness of about several μm to about several hundred μm and may be made of, for example, cellulose fiber such as Japan paper, clean paper, or clean wipe or an elastic body such as rubber.

Figure 3C:
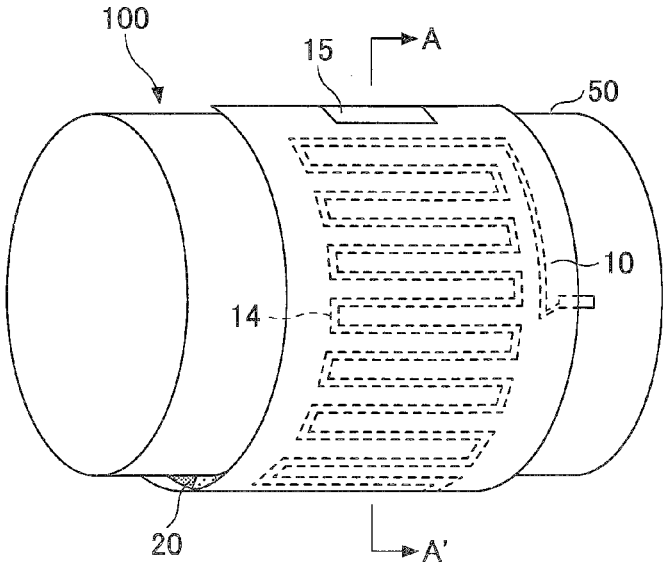

Finally, referring to FIG. 3C, the diaphragm 10 is rounded (curved) in its longitudinal direction and arranged on the buffer film 30 so as to cover the permanent magnet 20. Thereafter, both ends of the diaphragm 10 are fixed to the surface of the structure body 50 using a fixing member 15 properly formed.

At this time, it is preferable to fix the diaphragm 10 to the surface of the structure body 50 by positioning the diaphragm 10 so that the conductor wire pattern extending in the width direction of the coil 14 of the diaphragm 10 matches the side edges (border lines) of the magnet pattern of the north and south poles of the permanent magnet 20 positioned below the diaphragm 10.

Figure 4A:
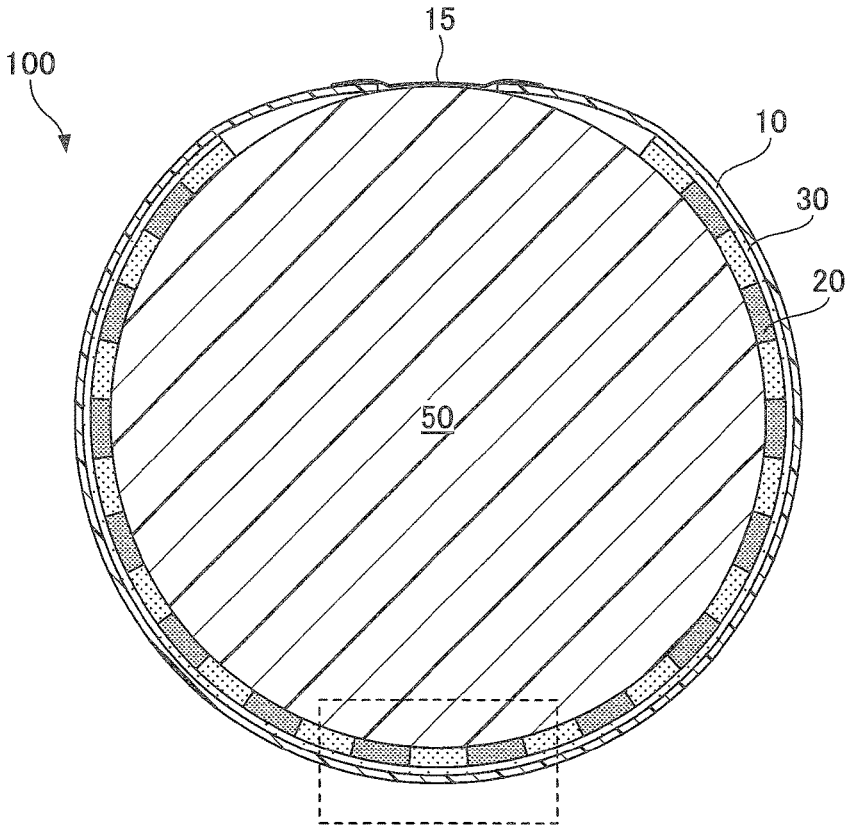
FIGS. 4A and 4B are cross-sectional views of the speaker structure.
Figure 4B:
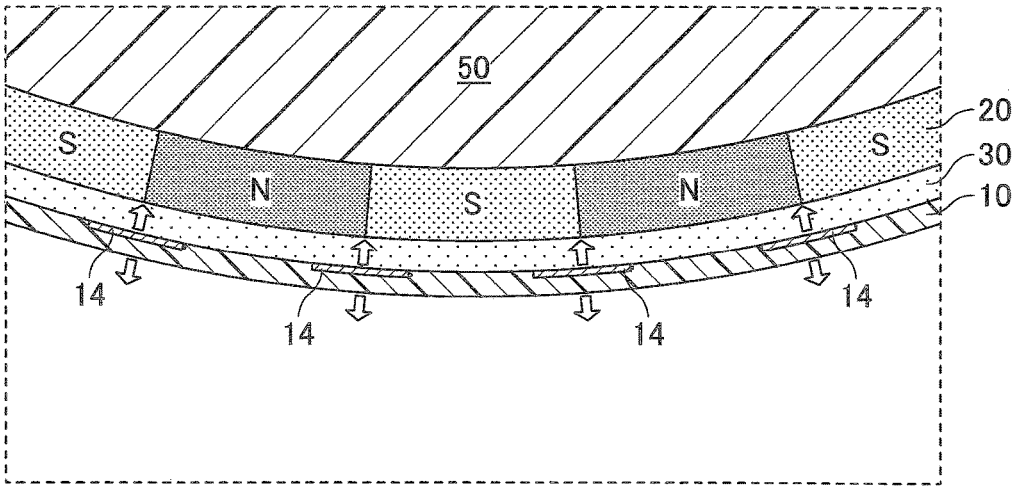

FIG. 4A is a cross-sectional view of the speaker structure 100 (see FIG. 3C), which is completed as described above, taken along a line A-A'. FIG. 4B is an enlarged view of a portion surrounded by a broken line in FIG. 4A.

Referring to FIG. 4B, magnetic-field components of arc-like magnetic lines of force extending from the north pole to the south pole contribute to generate an electromagnetic force in the coil 14 formed in the diaphragm 10. Among these magnetic-field components contributing to generate the electromagnetic force, a component in parallel with the surface of the permanent magnet 20 greatly contributes to generate the electromagnetic force. This component in parallel with the surface of the permanent magnet 20 has a maximum value (becomes a maximum) around a border between the north pole and the south pole in the magnet pattern.

Within the embodiment, if a magnetic field is generated by applying an alternating electric current to the coil 14, a repulsion force is generated in the coil by the electromagnetic force in conformity with the Fleming's left-hand rule. Therefore, the diaphragm 10 vibrates in the normal direction on the surface of the structure body 50. As described above, if the conductor wire pattern extending in the width direction of the coil 14 is positioned to match the side edges (border lines) of the north and south poles of the permanent magnet 20, the diaphragm 10 vibrates with the maximum efficiency so as to generate a necessary and sufficient sound pressure for a use as a speaker.

The magnet pattern of the permanent magnet 20 and the conductor wire pattern formed on the coil 14 are not limited to the above mode and may be another mode as long as the repulsion force is generated by the electromagnetic force upon the application of the electricity to the coil 14.

Figure 5A:
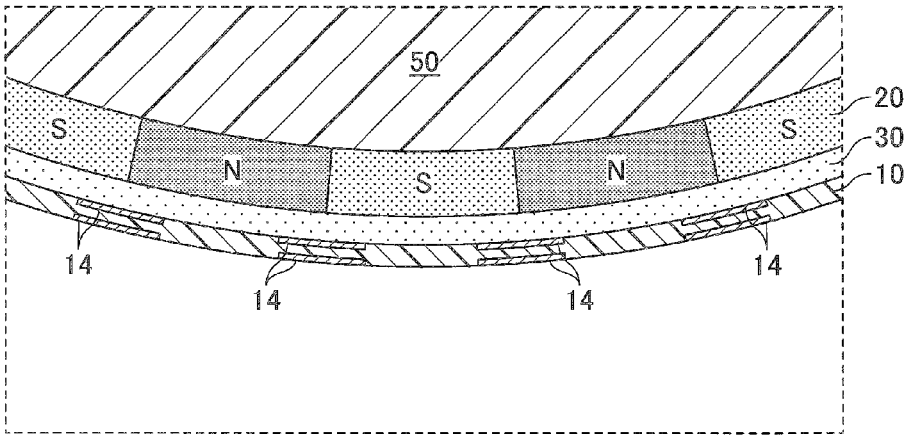
FIGS. 5A and 5B are cross-sectional views of improved speaker structures.
Figure 5B:
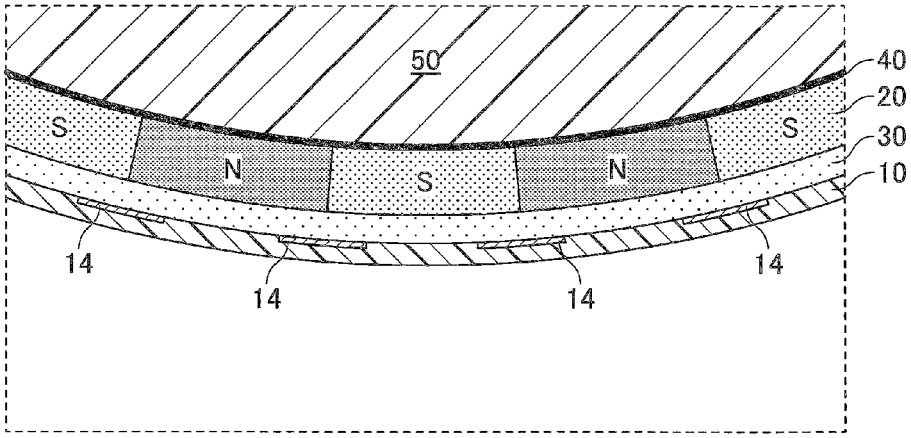

FIGS. 5A and 5B are cross-sectional views of improved speaker structures 100. FIG. 5A is an enlarged partial cross-sectional view of an area similar to that of FIG. 4B. FIG. 5A illustrates an embodiment where conductor wire patterns of the coil 14 are formed on both surfaces of the flexible substrate 12 of the diaphragm 10. According to this embodiment, the magnetic field generated by the application of the electric power becomes greater. Therefore, the amplitude is increased so as to generate a higher sound pressure.

FIG. 5B illustrates an embodiment where a highly magnetic permeable sheet 40 made of a material having a high magnetic permeability is arranged between the permanent magnet 20 and the structure body 50. Within this embodiment, a leak magnetic field on the back side (the side of the structure body 50) of the permanent magnet 20 decreases by the existence of the highly magnetic permeable sheet 40 so as to increase the leak magnetic field on the side of the coil 14 of the diaphragm 10. Therefore, a further higher sound pressure is generated.

<Example of Practical Configuration>

Figure 6A:
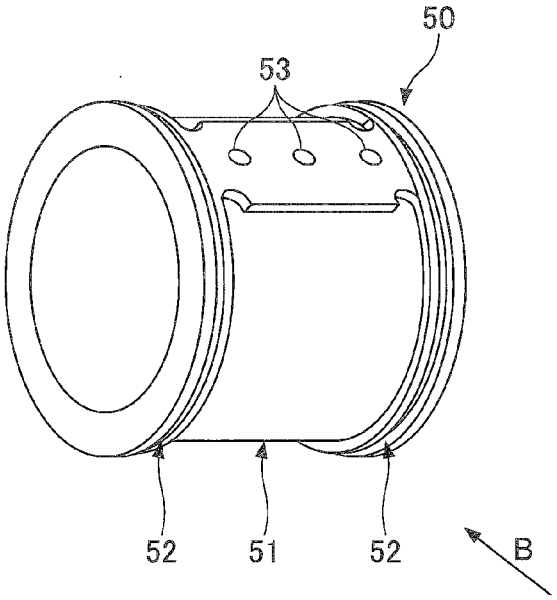
FIGS. 6A and 6B illustrate an exemplary structure body of a bobbin type.
Figure 6B:
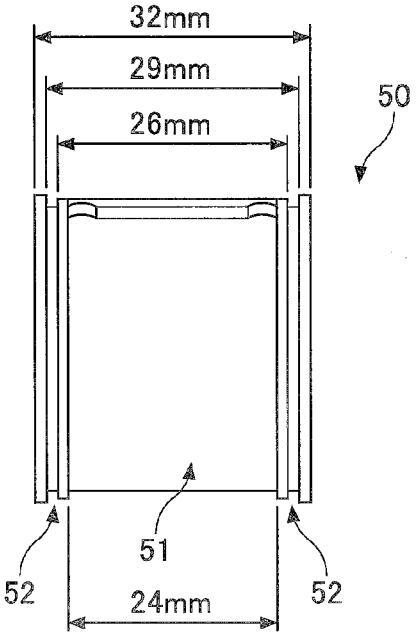

FIGS. 6A and 6B illustrate an example of the structure body of a bobbin type. FIG. 6A is a perspective view and FIG. 6B is a front view obtained by viewing along an arrow B in FIG. 6A. Exemplary sizes are provided for the socket component of the straight tube fluorescent lamp. The sizes of the structure body 50 are not limited thereto.

The structure body 50 of the bobbin type has a first groove 51, into which the permanent magnet 20 is embedded, on the surface of a hollow cylindrical body, and a second groove 52 for forming a space immediately below the slits 16 of the diaphragm 10 along both side edges in an arc-like shape. Further, a securing part 53 for fixing the diaphragm 10 is provided at an end (in a peripheral direction) of a protrusion forming the first groove 51.

The material of the structure body 50 is acrylonitrile butadiene styrene (ABS), polycarbonate (PC), polyetherether ether ketone(PEEK), or the like. ABS is low in cost, and is excellent in surface hardness and impact resistance in comparison with polypropylene (PP) and polyethylene (PE). PC has a balanced mechanical property, a good dimensional accuracy, a low water absorbability causing an excellent dimension stability, an extremely high impact resistance, and very good electric property. PEEK has a balanced mechanical property, a high dimensional accuracy, and a small water absorbability causing an excellent dimension stability. In consideration of the cost, ABS is used here. A processing method may be any one of cutting and molding. The structure body 50 is entirely processed by cutting including formation of the groove.

Figure 7:
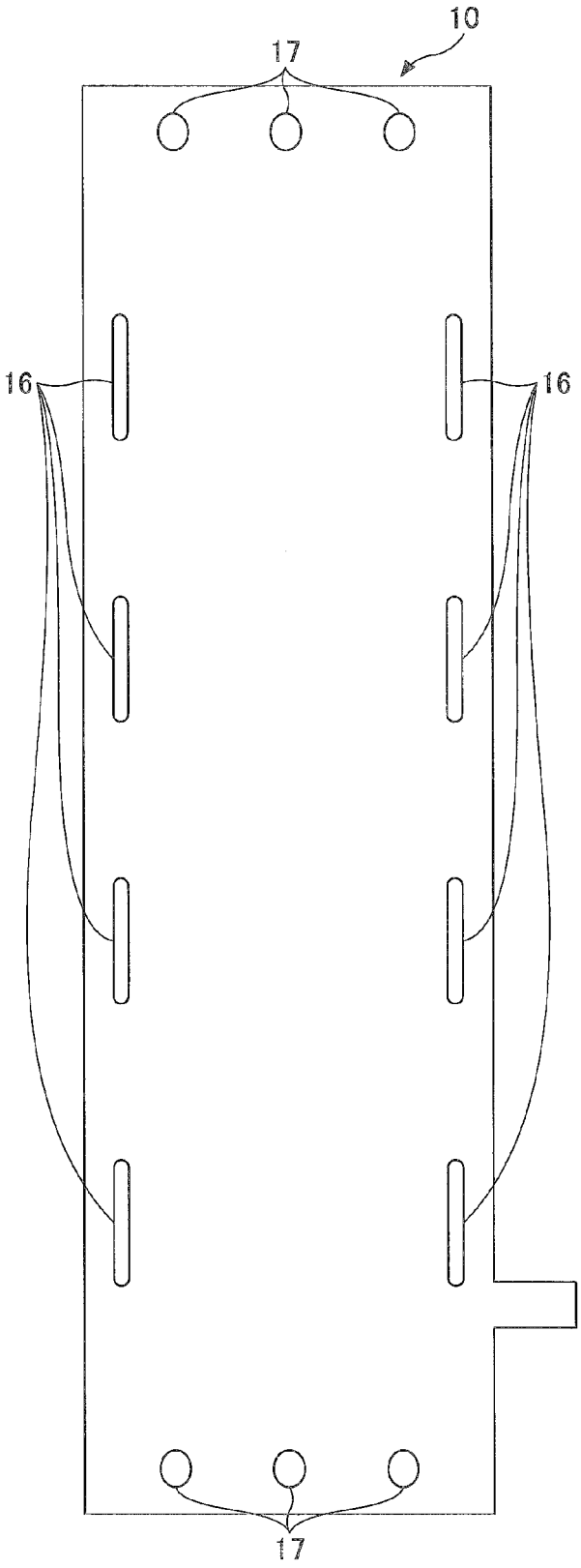
FIG. 7 illustrates an exemplary diaphragm corresponding to the structure body of the bobbin type.

FIG. 7 illustrates an exemplary diaphragm 10 corresponding to the structure body 50 of the bobbin type (the coil at the center is omitted from illustration). Securing holes 17 are provided at longitudinal end portions. Eight slits 16, i.e., four slits 16 in each of side edges of the longitudinal direction, are formed in the diaphragm 10. The permanent magnet 20 is similar to that illustrated in FIG. 2A.

Figure 8:
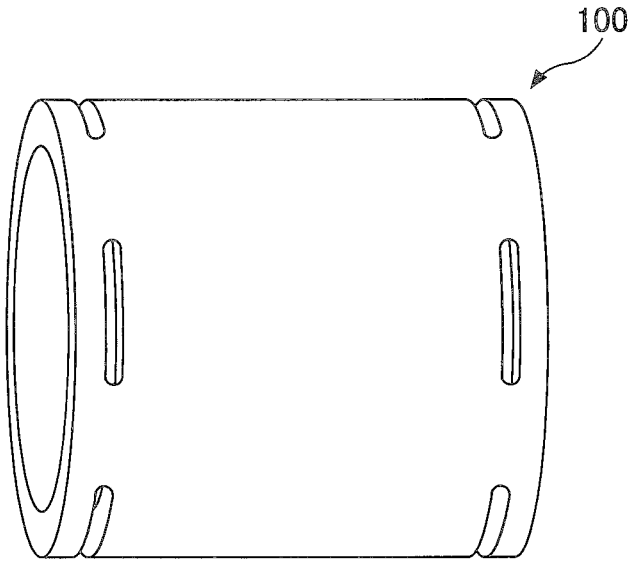
FIG. 8 illustrates an exemplary speaker structure.

FIG. 8 illustrates an exemplary speaker structure 100, which is formed by sequentially installing the permanent magnet 20 illustrated in FIG. 2A and the diaphragm 10 illustrated in FIG. 7 in the structure body 50 of the bobbin type illustrated in FIG. 6. The permanent magnet 20 is bonded to the first groove 51 of the structure body 50 by an adhesive. An epoxy resin (a one-component thermosetting adhesive (IW2010)) is used for bonding. The adhesive is temporarily hardened by applying heat at 80° C. (degrees) for ten minutes and further hardened by leaving it at a room temperature for 2 days or longer. The adhesive is not limited and may be a material durable to a reliability test (a heat cycle test or the like).

As illustrated in FIG. 6B, a wall of the ABS resin is formed between the first groove 51 and the second groove 52. By making the height of the wall from the bottom of the first groove 51 be greater than the thickness (for example, 1 mm) of the permanent magnet 20, a small gap (for example, 0.5 mm) is formed. The gap facilitates the vibration of the diaphragm 10. With this, the buffer film 30 illustrated in FIG. 3 can be omitted. The thickness of the permanent magnet 20 and the size of the gap is not limited to the above.

<Slit>

Figure 9A:
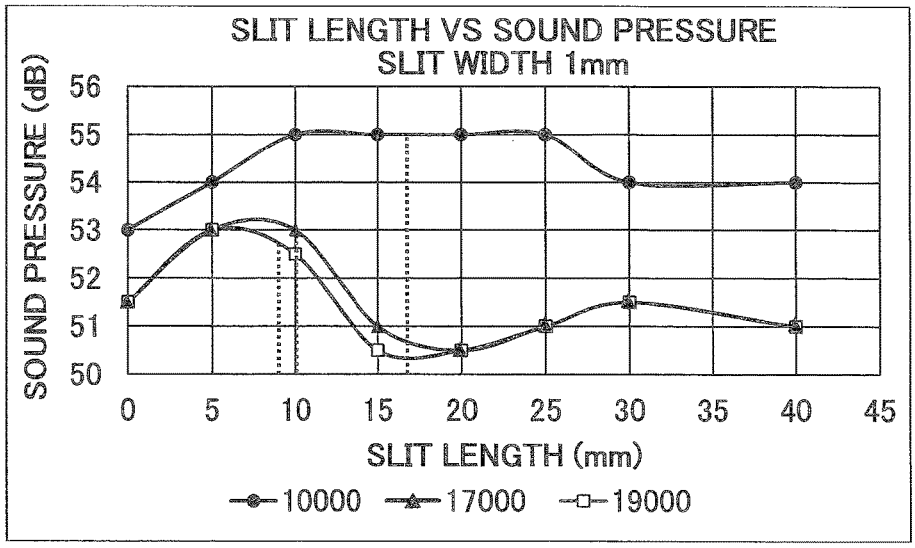
FIGS. 9A to 9C illustrate exemplary changes of a sound pressure with respect to a slit length.
Figure 9B:
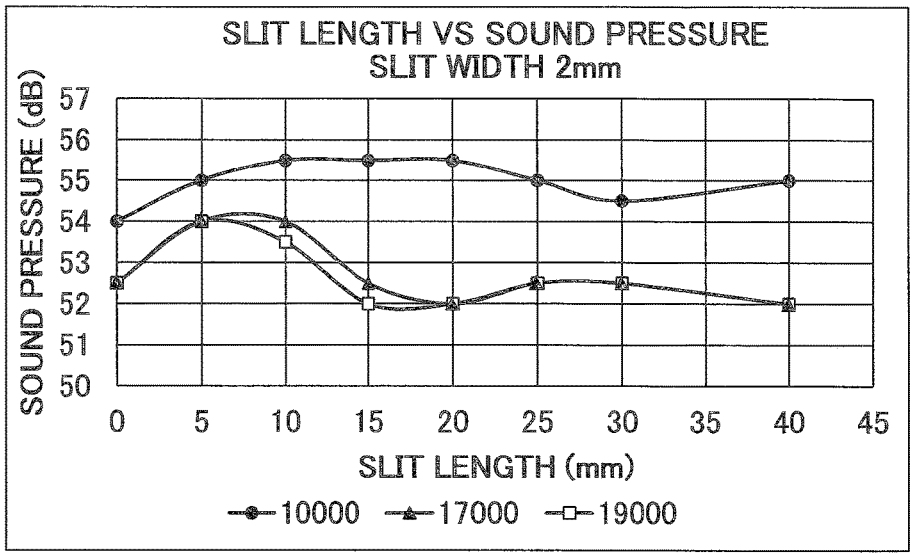
Figure 9C:
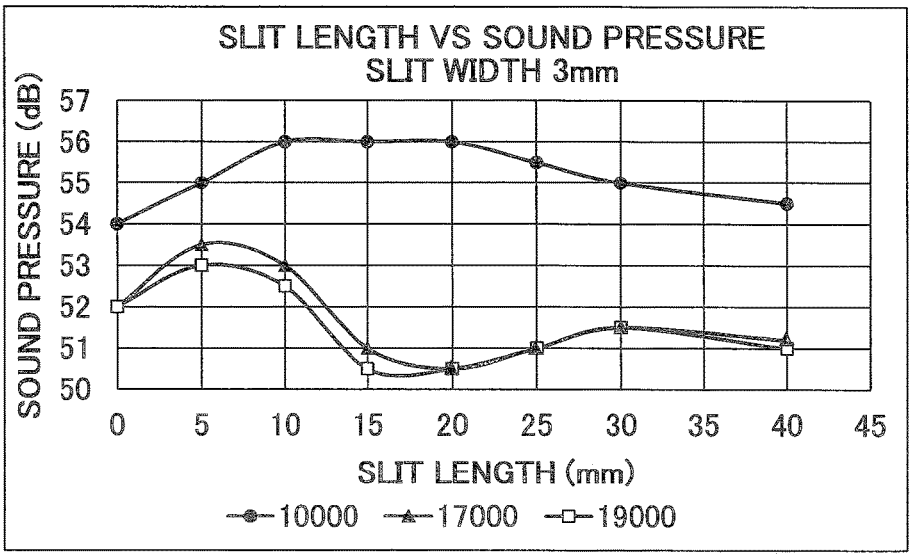

FIGS. 9A, 9B, and 9C illustrate exemplary changes of a sound pressure with respect to a slit length. In FIG. 9A, the slit width is 1 mm. In FIG. 9B, the slit width is 2 mm. In FIG. 9C, the slit width is 3 mm. A curved line marked by black circles corresponds to a signal frequency of 10 kHz. A curved line marked by black triangles corresponds to a signal frequency of 17 kHz. A curved line marked by squares corresponds to a signal frequency of 19 kHz.

A half wavelength of sound waves of 10 kHz is about 17 mm. A half wavelength of sound waves of 17 kHz is about 10 mm. A half wavelength of sound waves of 19 kHz is about 9 mm. As illustrated in FIG. 9, between the half wavelength and the quarter wavelength, the sound pressure is high.

Figure 10:
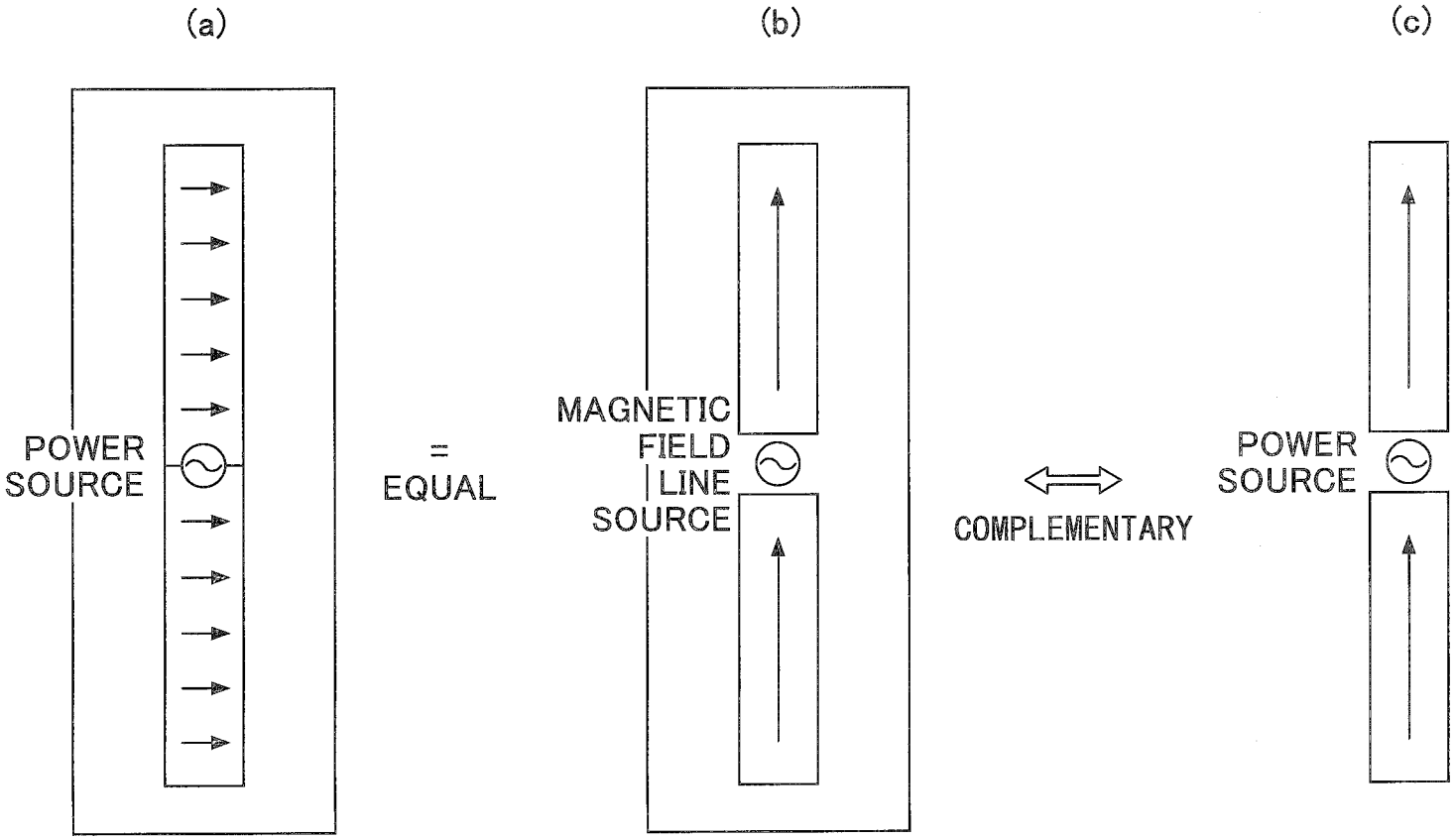
FIG. 10 is an exemplary slot antenna.
Figure 11A:
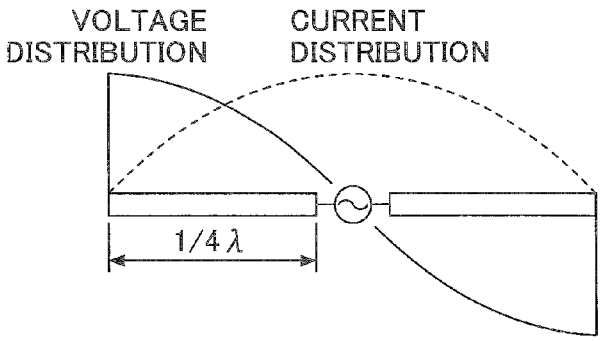
FIGS. 11A to 11C illustrate an exemplary distribution of a voltage or the like of a half-wave antenna.
Figure 11B:
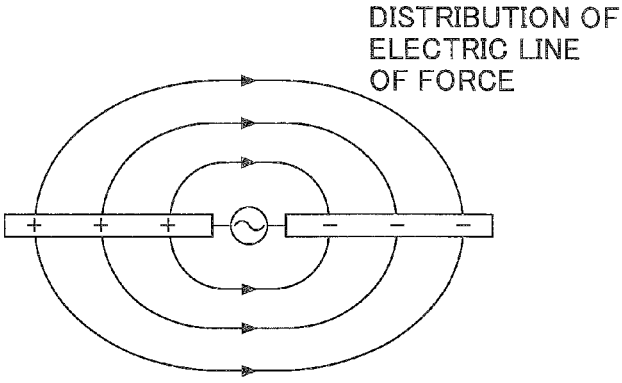
Figure 11C:
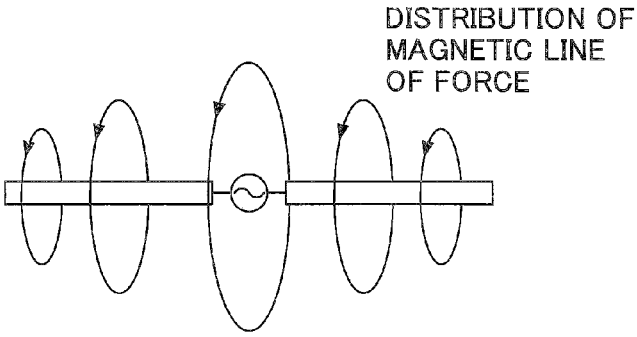

In a technical field of an electric wave, a slit antenna (or a slot antenna) is known. Referring to FIG. 10, a slot antenna illustrated in (a) is equivalent to a magnetic field dipole illustrated in (b) and is complementary to a plate-shaped dipole illustrated in (c). A half-wave antenna (a half-wave dipole) has a voltage distribution and a current distribution illustrated in FIG. 11A, a distribution of electric lines of force illustrated in FIG. 11B, and a distribution of magnetic lines of force illustrated in FIG. 11C. In a case of the slit antenna, when the slit length is the half wavelength, resonance is caused so as to maximize radiation.

Referring to FIG. 9, the reason why the peak of the sound pressure exists in the vicinity of the half wavelength of the sound waves is the same principle as the above slot antenna. However, another reason may exist. Said differently, the sound pressure may be reduced when the sound waves of an opposite phase interfere from a lower portion of the slit. Therefore, it is anticipated that the sound pressure of the opposite phase is low at positions where the slit width and the slit gap is around the half wavelength. In this test, it is confirmed that the peak of the sound pressure does not exist accurately at the half wavelength but exists between the half wavelength and the quarter wavelength. This test result is caused not only by the principle of the slit antenna but also by an interference of the sound waves caused through the slits. Therefore, it is preferable to set the wavelength of the opposite phase to a range of the half wavelength to the quarter wavelength of the used frequency, with which the interference of the sound waves of the opposite phase outgoing through the slits is minimized. The above explanation is similarly applicable to the gaps between the multiple slits. The shape of the slits is preferably rectangular so as to equalize the width of the vibration.

<Size of Diaphragm>

Figure 12:
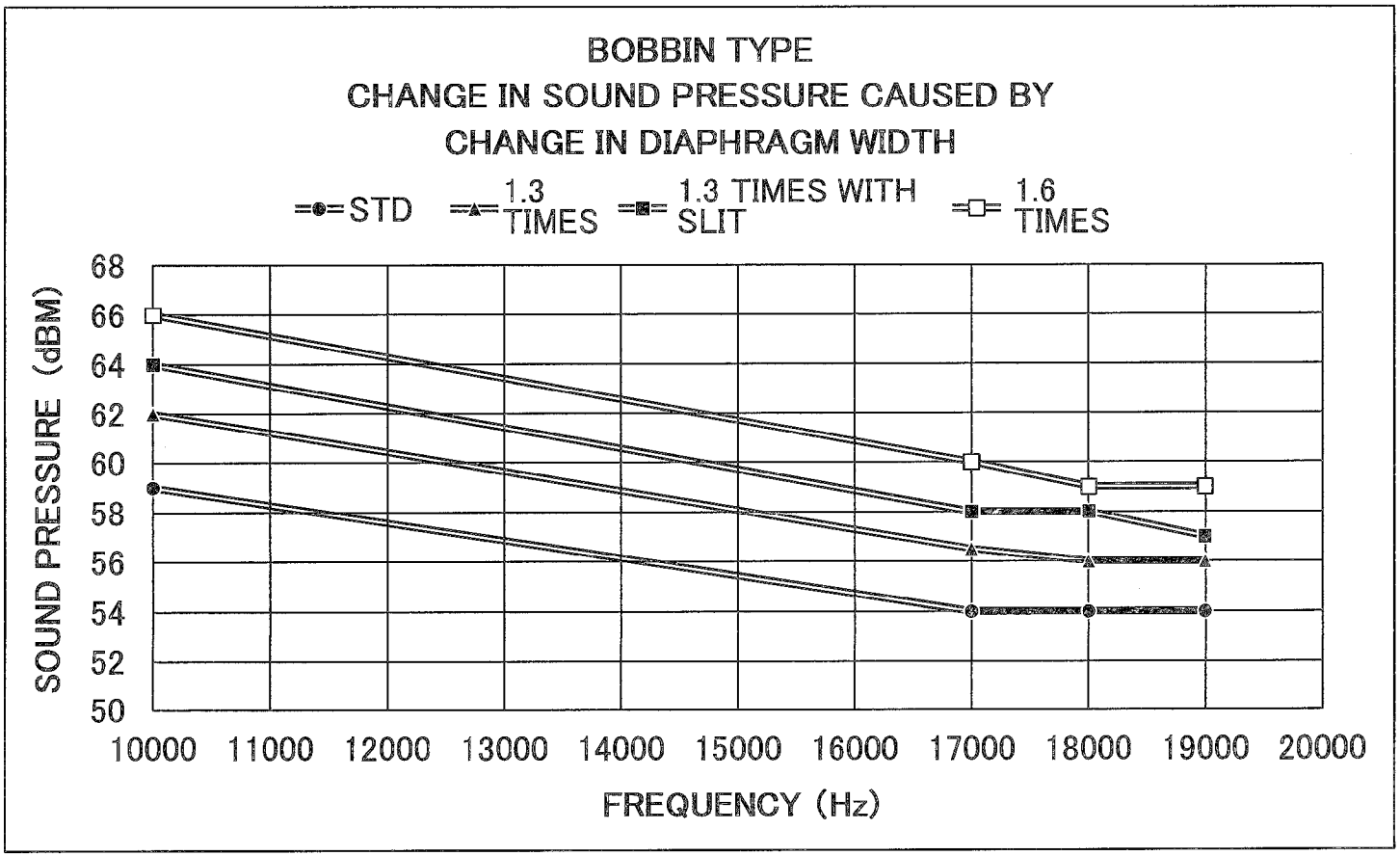
FIG. 12 illustrates a change in the sound pressure with respect to the frequency caused by a change in the diaphragm width.

The vibration (i.e., the sound pressure) of the same diaphragm becomes higher as the width is increased. FIG. 12 illustrates an exemplary sound pressure change with respect to the frequency for various widths of the diaphragm.

A curved line marked by black dots designates a sound pressure change for the frequency of a diaphragm without slit as a standard (STD). A curved line marked by black triangles designates a sound pressure change for the frequency of a diaphragm having the width of 1.3 times the width of the standard (STD). A curved line marked by black squares designates a sound pressure change for the frequency of a diaphragm having the width of 1.3 times the width of the standard (STD) and also having a slit (for example, the slit length: 8 mm, and the slit width: 2 mm). A curved line marked by white squares designates a sound pressure change for the frequency of a diaphragm having the width of 1.6 times the width of the standard (STD). In a case where the width of the diaphragm is 1.3 times of that of the standard, the area of a magnetic field applied to an electric current flowing through the coil become 1.3 times of that of the standard. Therefore, depending on "Fleming's force=current×magnetic field", the sound pressure becomes about 1.3 times of that of the standard (corresponding to 3 dB). In a case where the width of the diaphragm is 1.6 times of that of the standard, the sound pressure becomes about 1.6 times of that of the standard.

By enlarging the diaphragm, the vibration and the sound pressure certainly increases. However, it is not efficient to increase only the area of the diaphragm and there may be inconvenience in a relationship with a location where the diaphragm is installed for increasing the vibration and the sound pressure. For example, in consideration of an example where sound is emitted by wrapping the diaphragm around a straight tube fluorescent lamp, an LED illumination, or the like, the increment of the area of the diaphragm causes a region hiding a light emitting portion to be increased. Then, the brightness is decreased and inconvenience occurs. Therefore, it is desirable to set the vibrating region as small as possible and the sound pressure as high as possible. Among the examples of FIG. 12, in a case where the sound pressure is improved, the width and the area of the diaphragm are set to 1.3 times of those of the standard and the slits are inserted. Then, it is considered to be advantageous because the sound pressure can be improved by 5 dB to 6 dB.

EXAMPLES

As for the speaker structure using the structure body of the bobbin type illustrated in FIGS. 6A to 8, the size of the diaphragm (FPC: Flexible Printed Circuits) and the position, the number, and the size of the slit are variously changed to obtain Examples 1 to 20 (see FIGS. 13-15). A measurement result of the sound pressure in a representative frequency is provided for each of the embodiments.

Examples 1 to 7 illustrated in FIG. 13 correspond to cases where the arrangement and the number of the slits are variously changed. Examples 8 to 17 illustrated in FIG. 14 correspond to cases where the sizes of the slits are minutely changed. Examples 18 to 20 illustrated in FIG. 15 correspond to cases where the results of Examples 1 to 17 are comprehensively changed.

Within Examples 1 to 20, a polyimide resin film (a film thickness of 20 μm) having coils (copper patterns of a thickness of 9 μm and a pitch of 3 mm) on both surfaces of the polyimide resin film is used as the diaphragm. Further, the permanent magnet is a bond-system Nd magnet (a leak magnetic field of ±100 gauss, a thickness of 1 mm, and a pitch of band magnet of 3 mm) is arranged in an attachment groove region so as to be externally attached.

Specifications of Examples 18 to 20 illustrated in FIG. 15 are as follows. The length of the diaphragm is 118 mm, and the width of the diaphragm is 36 mm. The used frequency is from 17 kHz to 19 kHz. Therefore, the slit length is determined to be 8 mm, which is the half wavelength or smaller where the sound pressure can be improved. In a case where there is the slit, the slit width is determined to be 1 mm or 2 mm. Eight slits (four slits on each side of the coil extending in the longitudinal direction) are arranged at an equal gap.

Figure 16:
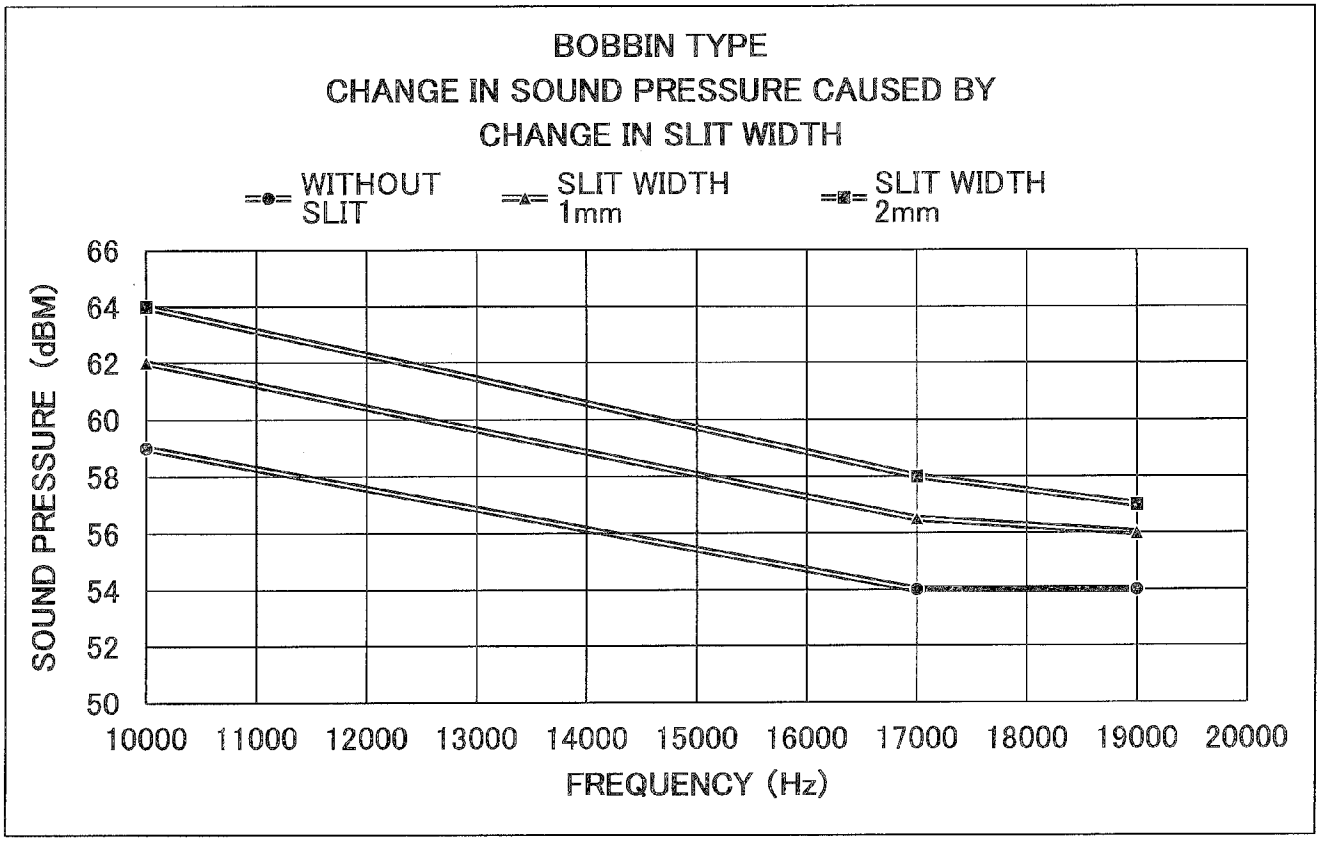
FIG. 16 illustrates a change in the sound pressure with respect to the frequency caused by a change in the slit width.

FIG. 16 illustrates an exemplary sound pressure with respect to a slit width change of the diaphragm. A curved line marked by black circles designates Example 18 without the slit. A curved line marked by black triangles designates Example 19 using a slit width of 1 mm. A curved line marked by black triangles designates Example 20 using a slit width of 2 mm. According to the result, Example 20 is preferable.

<Evaluation of Directionality Characteristics>

Sounds respectively output from the speaker (the speaker structure) of Example 20 and a speaker without a slit of a comparative example are measured to examine directionality characteristics. In this test, a distance from the speaker to a mic (manufactured by ACO CO., LTD, Type 4152: non-directionality) was 50 cm. A sound output from the speaker is measured at four measurement positions at relative peripheral angles of 0°, 30°, 60°, and 90° around a reference line through the center of the speaker illustrated in FIG. 17A and four measurement positions at relative angles of 0°, 30°, 60°, and 90° with respect to the longitudinal direction of a reference line through the center of the speaker illustrated in FIG. 17B.

The sound source was generated by free software (WaveGene, ver 1.4) by which a sound at a single frequency is output. Two types (10 kHz and 20 kHz) of the sound output from the speaker were measured by sound pressure measurement software (Spectra, manufactured by ACO CO., LTD).

Figure 17A:
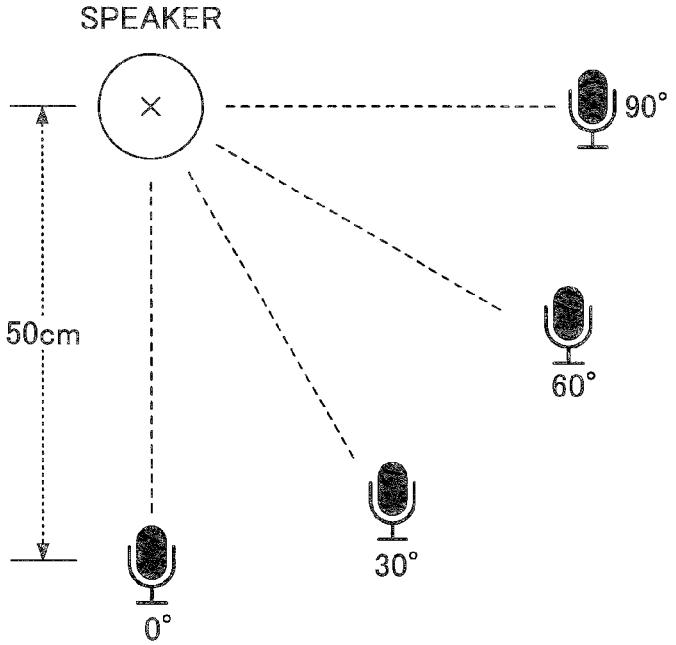
FIGS. 17A and 17B illustrate exemplary measurement methods to measure directivity characteristics.
Figure 17B:
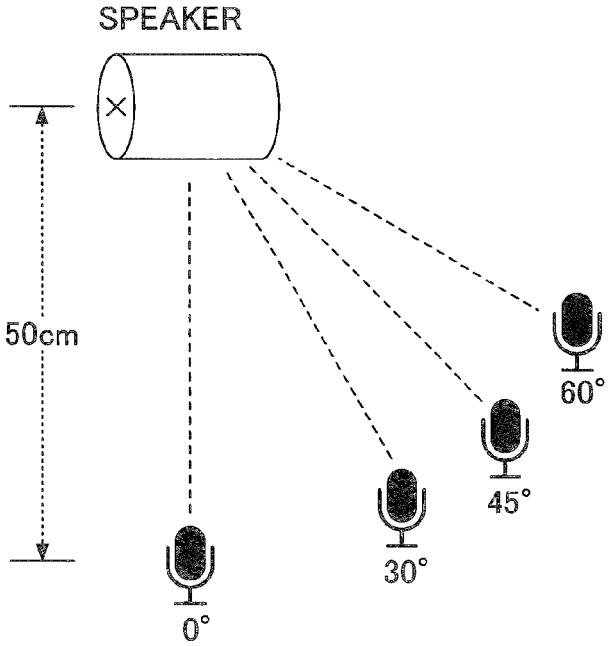

FIG. 18A is an example of the measurement result in the state illustrated in FIG. 17A. FIG. 18B is an example of the measurement result in the state illustrated in FIG. 17B.

From these measurement results, in the comparative example, the measured sound pressure (dB) decreases as the relative angle around the reference line vertical to the diaphragm increases so as to show a directionality. However, within Example 20, it is observed that the measured sound pressure (dB) does not greatly change as the relative angle around the reference line vertical to the diaphragm increases. Therefore, it is known that the speaker of this embodiment has non-directionality.

<Application or the Like to Socket Component of Straight Tube Fluorescent Lamp>

When a conventional cone-type speaker is added to the socket component of the straight tube fluorescent lamp, it is unavoidable to adopt a small speaker (a diaphragm) because of a limited space. In this case, a sufficient spread of the sound cannot be anticipated.

In the speaker structure of the embodiment, it is possible to attach the speaker structure using the cylindrical curved surface of the socket component of the straight tube fluorescent lamp. In this case, the sound waves generated by the diaphragm having the arc-like curved surface propagate into wide ranges (in normal directions of the curved surface of the diaphragm).

A mode of using the socket component of the above straight tube fluorescent lamp is an example. Any structure having a curved surface can be used as the region to which the speaker structure of the embodiment is attached.

Although a mode of additionally attaching the speaker structure to the region having the curved surface of the known structure body is disclosed, a dedicated structure body may be prepared to configure the speaker structure.

<Example where Slits are Arranged in a Longitudinal Direction and a Direction Vertical to the Longitudinal Direction>

Described above is an example where multiple slits are arranged along edges in the longitudinal direction of the diaphragm with reference to FIG. 7 or the like. However, multiple slits may be further arranged in a direction vertical to the longitudinal direction in a center portion of the diaphragm.

Figure 19A:
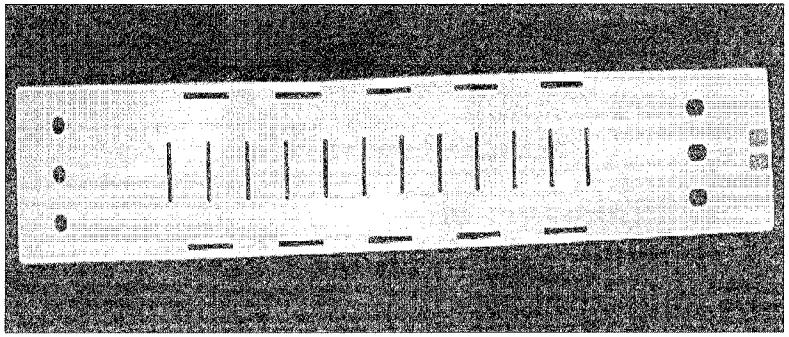
FIGS. 19A and 19B illustrate exemplary states where slits are arranged in a longitudinal direction and a direction perpendicular to the longitudinal direction.
Figure 19B:
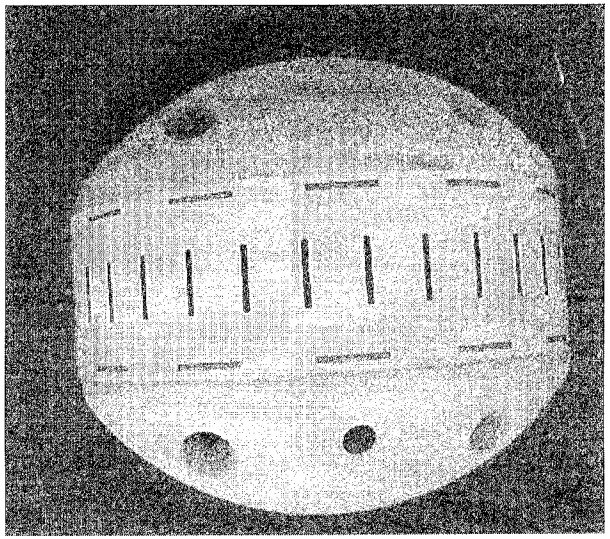

FIGS. 19A and 19B illustrate the example where the slits are arranged in the longitudinal direction and the direction vertical to the longitudinal direction. FIG. 19A illustrates only the diaphragm, and FIG. 19B illustrates a speaker structure which is configured by forming a magnet and the diaphragm on a base. The base is manufactured by a 3D printer and the material of the base is an ABS resin (a generic name of a copolymerization synthetic resin including acrylonitrile, butadiene, and styrene). The magnet is a bond system magnet in a manner similar to the other embodiments. The side having a stronger magnetic field is arranged on a side of the coil.

Figure 20:
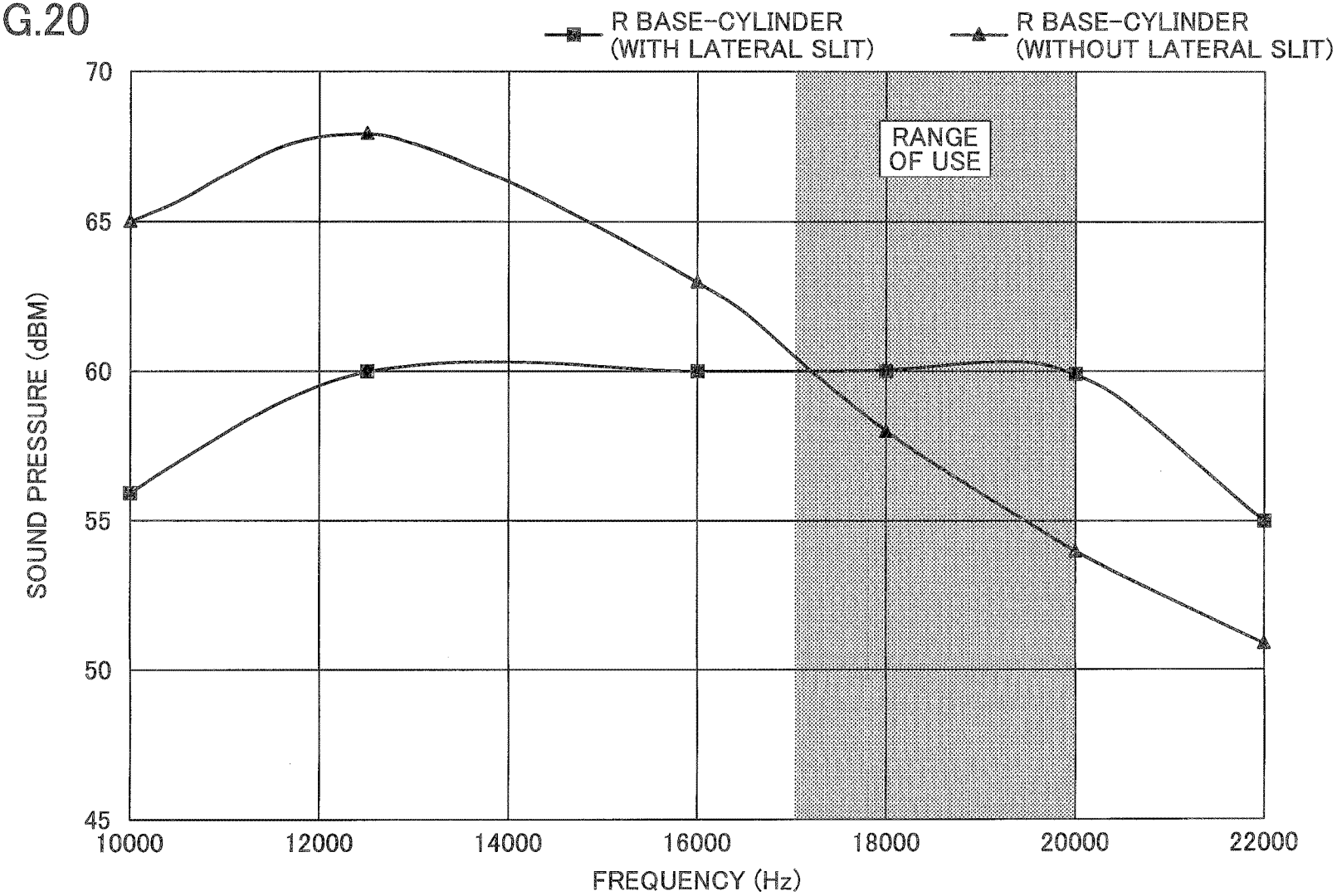
FIG. 20 illustrates an exemplary measurement result of sound pressure characteristics.

FIG. 20 illustrates an example of the measurement result of the sound pressure characteristics. A curved line marked by black squares designates a case where the slits (lateral slits) are arranged in a lateral direction. For comparison, a curved line marked by black triangles designates a case where the slits are not arranged in a lateral direction (without the lateral slit). A measurement system of measuring the sound pressure is similar to that illustrated in FIG. 17.

Referring to FIG. 20, it is known that the sound pressure is improved between 17 kHz to 20 kHz of the used frequency in comparison with a case where there is no lateral slit.

<Example where a Heat Resistance is Enhanced>

Since the diaphragm (FPC) is mainly made of a polyimide material, the diaphragm (FPC) satisfies the UL94V-0 of a flame retardance standard. However, because the magnet is mainly made of a rubber, there are problems that the magnet is molten at a high temperature and the magnetic force is weakened by temperature characteristics (weak to heat) of the magnet.

Therefore, a sheet formed by weaving a metal or a glass in a fibrous form as a flexible and incombustible material is provided between the FPC of the diaphragm and the magnet.

Figure 21:
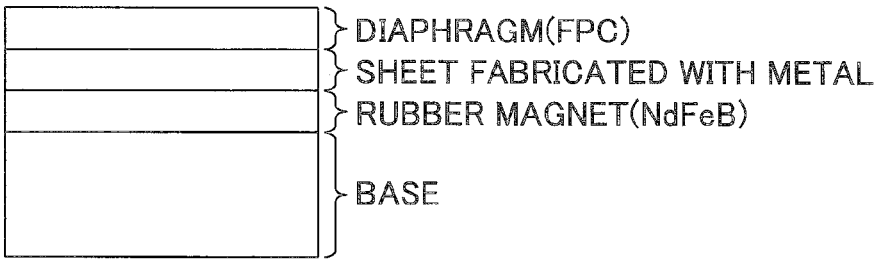
FIG. 21 is an exemplary cross-sectional view of a diaphragm, a sheet, a rubber magnet, and a base.

FIG. 21 is an exemplary cross-sectional view including the diaphragm, a sheet, the rubber magnet, and the base. Between the diaphragm (FPC) and the rubber magnet, the sheet formed by weaving the metal or the glass in a fibrous form into the sheet is provided.

A simple stainless mesh can be used as the metal to be woven. However, because there is a problem in a flexibility, it is desirable to use a conductive cloth or a conductive nonwoven fabric.

Figure 22A:
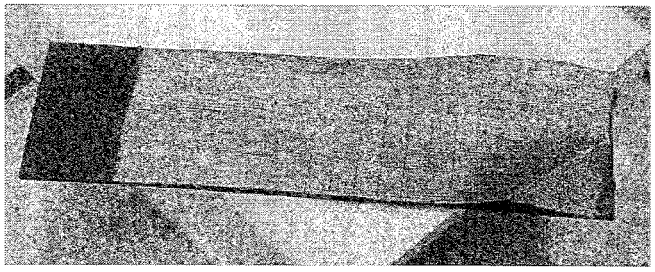
FIGS. 22A and 22B illustrate states where heat is applied to the sheet and the rubber magnet.
Figure 22B:
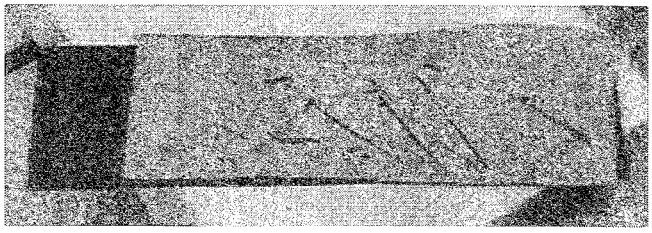

FIGS. 22A and 22B illustrate a state where heat is applied to the sheet formed by weaving the metal or the glass into the sheet and the rubber magnet. FIG. 22A illustrates a state before applying the heat to the sheet and the rubber magnet. FIG. 22B illustrates a state after applying the heat by a tip part of a soldering iron to the sheet and the rubber magnet. Without providing the sheet, the rubber magnet is molten. When the sheet formed by weaving the metal or the glass into the sheet is provided, as illustrated in FIG. 22B, the rubber magnet is not burnt, and a rubber element of the rubber magnet adheres into the metallic mesh so that the rubber magnet is not molten and flown out of the sheet.

The sheet formed by weaving the metal or the glass in the fibrous form was Sui-50-KL95 (SEIREN Co., Ltd.) of a flame retardant type (satisfying the UL94V-0 standard) formed by weaving Cu/Ni into the sheet. However, the sheet is not limited thereto. When the sheet is formed by weaving the glass, a glass cloth may be used. When a Teflon-impregnated glass cross sheet fabric ("Teflon" is a registered trademark) (a thickness of 0.1 mm, FGF-500-4-1000W, manufactured by Chukoh Chemical Industries, Ltd.) is used, a change scarcely occurs when heat is applied by the tip part of the soldering iron. This may be caused by a high heat resistance of the Teflon-impregnated glass cross sheet fabric.

Because the conductive cloth or the conductive nonwoven fabric has conductivity, a surface treatment is provided on the diaphragm (FPC) to form an insulating layer including titanium oxide. The insulating layer having a thickness of 30 μm is formed on both surfaces of the FPC by using a white-colored heat-resistant solder resist ink (Taiyo Ink Mfg. Co., Ltd.), a hand-printing desktop-type screen printer NJ-15PHP (Neotechno Japan Corporation), and a printing block of 120 μm mesh (TOKYO PROCESS SERVICE Co., Ltd.). By using this insulating layer, there are effects that insulation properties of insulating from the conductive cloth and the conductive nonwoven fabric are maintained, flame retardant properties are performed as described below, the heat conductivity is performed, and both the conductive cloth and the conductive nonwoven fabric prevent a heat characteristic from easily changing.

Film Performance

Item: insulation resistance; Test method: AC impedance method; Test result: $2\times10^9$ MΩ

Item: flame retardant properties; Test method: UL standard; Test result: corresponding to V-0

Item: heat conductivity; Test method: laser flash method; Test result: 1.0 W/mK

The magnetic force is measured on the surface of the rubber magnet and on the sheet after mounting the sheet on the surface of the rubber magnet using an apparatus (Gauss meter, TGM-400, manufactured by TOYOJIKI INDUSTRY CO., LTD). The magnetic force is 200 mT in the south pole and the north pole, which are substantially the same properties on the surface of the rubber magnet and on the sheet after mounting the sheet on the surface of the rubber magnet using an apparatus.

Figure 23:
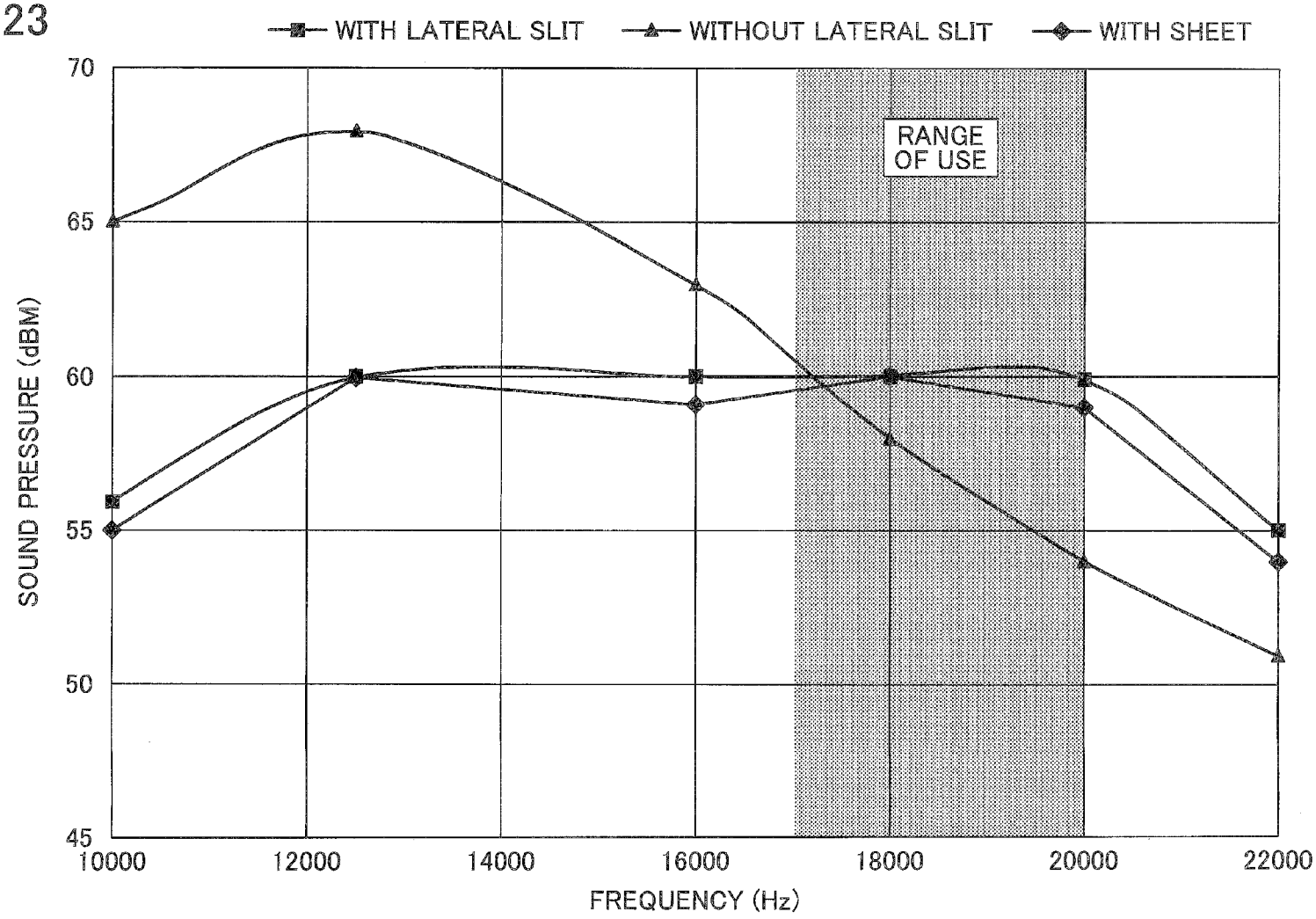
FIG. 23 illustrates an exemplary measurement result of frequency characteristics of the speaker structure.

FIG. 23 illustrates frequency characteristics of the speaker structure at the ambient temperature of 40° C. In a case where the sheet exists, the sound pressure in 17 kHz to 20 kHz to be used is good.

SUMMARIZATION

As described above, within the embodiment, it is possible to provide an energy conversion apparatus which can be easily attached to various structure bodies and can enhance an energy conversion efficiency.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although an energy conversion apparatus has been described in detail, it should be understood that various changes, substitutions, and alterations could be made thereto without departing from the spirit and scope of the invention.

This application is based upon and claims the benefit of priority of the prior Japanese Patent Application No. 2014-163638, filed on Aug. 11, 2014, and the Japanese Patent Application No. 2015-082216, filed on Apr. 14, 2015, the entire contents of which are incorporated herein by reference.

What is claimed is:

1. An electroacoustic transducer comprising:

a permanent magnet fixed to-a surface of a substrate; and a diaphragm arranged on the permanent magnet, the diaphragm including a coil having a conductor wire pattern formed on the diaphragm, wherein the diaphragm includes a slit formed in the diaphragm, wherein the slit includes a plurality of slits periodically formed in the diaphragm, and wherein lengths of the plurality of slits and a gap between the plurality of slits are a half to quarter wavelength of a minimum frequency of a signal applied to the coil.

2. The electroacoustic transducer according to claim 1, wherein the surface of the substrate is curved.

3. A speaker structure comprising, the electroacoustic transducer according to claim 1.

4. The speaker structure according to claim 3, wherein the slit includes a plurality of slits periodically formed in the diaphragm, and the plurality of slits are formed in both directions of a longitudinal direction of the diaphragm and a direction perpendicular to the longitudinal direction.

5. The speaker structure according to claim 3, further comprising:

a sheet provided between the permanent magnet and the diaphragm, the sheet being formed by weaving a metal or a glass in a fibrous form into the sheet.

6. The speaker structure according to claim 3, wherein an insulating layer including at least titanium oxide is formed on a surface of the diaphragm.

7. The electroacoustic transducer according to claim 1, wherein the permanent magnet is formed in a rectangular shape, and with alternating bands of north pole regions and south pole regions that extend in a widthwise direction of the rectangular shape of the permanent magnet.

8. The electroacoustic transducer according to claim 7, wherein a pitch between each of the widthwise extending north pole region and the widthwise extending south pole is equal to a pitch of the coil formed on the diaphragm.

9. The electroacoustic transducer according to claim 7, wherein the diaphragm is positioned over the permanent magnet a conductor wire pattern of the coil formed on the diaphragm lies over a border between the north pole region and the south pole region of the permanent magnet.

* * * * *